United States Patent [19]

Doe

[11] Patent Number: 4,880,551

[45] Date of Patent: Nov. 14, 1989

[54] ANTIOXIDANT SYNERGISTS FOR LUBRICATING COMPOSITIONS

[75] Inventor: Lester A. Doe, Newtown, Conn.

[73] Assignee: R. T. Vanderbilt Company, Inc., Norwalk, Conn.

[21] Appl. No.: 333,874

[22] Filed: Apr. 3, 1989

Related U.S. Application Data

[63] Continuation-in-part of Ser. No. 204,487, Jun. 6, 1988, abandoned.

[51] Int. Cl.[4] ..... C10M 105/72; C10M 105/22

[52] U.S. Cl. ..... 252/47.5; 252/45; 252/47; 252/50; 252/48.6; 252/51.5 R; 252/52 R

[58] Field of Search ..... 252/47.5, 50, 45, 47, 252/48.6, 51.5 R, 52 R

[56] References Cited

U.S. PATENT DOCUMENTS

| | | | |
|---|---|---|---|
| 3,931,022 | 1/1976 | Chesluk | 252/47.5 |
| 4,060,491 | 11/1977 | Bridger | 252/50 |
| 4,177,155 | 12/1979 | Popplewell et al. | 252/49.3 |
| 4,701,273 | 10/1987 | Brady | 252/32.5 |
| 4,734,209 | 3/1988 | Phillips | 252/47 |

FOREIGN PATENT DOCUMENTS

| | | |
|---|---|---|
| 1466558 | 3/1977 | United Kingdom . |
| 1472527 | 5/1977 | United Kingdom . |
| 1511593 | 5/1978 | United Kingdom . |
| 1514359 | 6/1978 | United Kingdom . |

OTHER PUBLICATIONS

Bachman et al, *The Condensation of Aldehydes and Amines with Nitrogenous Five-atom Ring Systems,* 68 J.A.C.S. 2496 (1948).

Licari et al, *Studies with Mannich Bases Involving N-Heterocycles and Primary Aromatic Amines,* 77, J.A.C.S 5386 (1955).

Smith et al, *Isomerism of 1-and 2-(NN-Disubstituted aminomethyl) benzotriazoles; and Investigation by Nuclear Magnetic Resonance Spectroscopy,* J.C.S. Perkin Trans., I, 1181 (1975).

*Primary Examiner*—William R. Dixon, Jr.
*Assistant Examiner*—James M. Hunter, Jr.
*Attorney, Agent, or Firm*—Rasma B. Balodis

[57] ABSTRACT

This invention relates to synergistic antioxident compositions consisting of (a) 1-[di(4-octylphenyl)aminomethyl]tolutriazole and (b) an antioxidant selected from the group consisting of methylenebis(di-n-butyldithiocarbamate), 2,6-di-t-butyl-4-sec-butylphenol, 2,6-di-t-butyl-4-methylphenol and butylated phenol mixture and lubricating compositions containing same.

2 Claims, No Drawings

ANTIOXIDANT SYNERGISTS FOR LUBRICATING COMPOSITIONS

This is a continuation-in-part of application Ser. No. 07/204,487 filed June 6, 1988 abandon.

BACKGROUND OF THE INVENTION

This invention concerns lubricating compositions having improved resistance to oxidation. Another aspect of the invention relates to antioxidant synergists and their incorporation in lubricating compositions to improve resistance to oxidation thereof.

Lubricating oils, greases and similar oleaginous materials are used under conditions which contribute to their breakdown during normal service. The severe high temperature operating conditions of modern engines accelerate deterioration of lubricants due to oxidation. Oxidative deterioration is accompanied by formation of gum, sludge and acids which may cause corrosion of the engine as well as chemical breakdown of the lubricant.

Additives performing as antioxidants are often corrosive themselves or break down during normal use into corrosive substances which result in severe corrosive attack on metals and premature replacement of machinery.

It is known that certain alkyl substituted benzotriazole derivatives possess metal passivating properties as described in British Patent Specifications Nos. 1,511,593 and 1,466,558. Furthermore, U.S. Pat. No. 4,701,273 teaches that methylated 1-[di(2-ethylhexyl-)aminomethyl]benzotriazole displays a synergistic action with respect to metal deactivation and oxidation inhibition when used in conjunction with a select group of antioxidants.

Surprisingly, it has been discovered that a phenyl derivative of tolutriazole shows unexpected synergistic effect with respect to antioxidant activity in lubricants when used in conjunction with one of several antioxidants.

SUMMARY OF THE INVENTION

According to the invention, there are provided synergistic antioxidant compositions containing (a) 1-[di(4-octylphenyl)aminomethyl]tolutriazole and (b) an antioxidant selected from the group consisting of methylenebis(di-n-butyldithiocarbamate), 2,6-di-t-butyl-4-sec-butylphenol, 2,6-di-t-butyl-4-methylphenol and butylated phenol mixture and wherein the ratio of the tolutriazole compound to the antioxidant ranges from about 1:4 to about 4:1.

Another aspect of the invention concerns lubricating compositions having improved antioxidant properties and comprising a major portion of an oil of lubricating viscosity and an oxidation inhibiting amount of a synergistic antioxidant composition containing (a) 1-[di(4-octylphenyl)aminomethyl]-tolutriazole and (b) an antioxidant selected from the group consisting of methylenebis(di-n-butyldithiocarbamate), 2,6-di-t-butyl-4-sec-butylphenol, 2,6-di-t-butyl-4-methylphenol and butylated phenol mixture.

DETAILED DESCRIPTION OF THE INVENTION

The 1-[di(4-octylphenyl)aminomethyl]tolutriazole synergist is prepared in a known manner from tolutriazole, formaldehyde and dioctylated phenylamine by means of the Mannich reaction. Tolutriazole designates benzotriazole compound which is methylated in the benzene ring in the 4-position and/or 5-position. The material is commercially available.

The antioxidant synergists are known materials and are commercially available under the following trade names: VANLUBE ® 7723, methylenebis(di-n-butyldithiocarbamate), VANOX ® 1320, 2,6-di-t-butyl-4-sec-butylphenol, VANLUBE PC, 2,6-di-t-butyl-4-methylphenol, all distributed by R. T. Vanderbilt Company, Inc. and "ETHYL" Antioxidant 732 manufactured by Ethyl Corporation. "ETHYL" Antioxidant 732 contains a major amount of 2,6-di-t-butylphenol and minor amounts of 2,4,6-tri-t-butylphenol, and ortho-t-butylphenol. Unexpectedly, the tolutriazole compound produces synergistic antioxidant effect when combined with one of the above described antioxidants in certain critical ratios. Synergism is displayed by compositions containing about 1 to 4 parts by weight of the tolutriazole compound to about 4 to 1 part by weight of the antioxidant.

The synergistic compositions may be incorporated in any lubricating media by known methods. The compositions impart metal deactivating as well as oxidation inhibiting properties to natural and synthetic lubricants formulated as oils or greases.

The base oils employed as lubricant vehicles are typical oils used in automotive and industrial applications such as, among others, turbine oils, hydraulic oils, gear oils, and crankcase oils. The base oil may be selected from oils derived from petroleum hydrocarbon and synthetic sources. The hydrocarbon base oil may be selected from naphthenic, aromatic, and paraffinic mineral oils. The synthetic oils may be selected from, among others, alkylene polymers, polysiloxanes, carboxylic acid esters and polyglycol ethers.

The compositions of the invention may be incorporated in the lubricating compositions in an amount effective to produce the desired oxidation inhibiting characteristics. Typically, the amount may range from about 0.01 to 5.0 percent by weight based on the total weight of the lubricating composition. The preferred range is about 0.1 to 3.0 percent of the additive based on the total weight of the lubricating composition.

The lubricating compositions may contain the necessary ingredients to prepare the composition, as for example dispersing agents, emulsifiers, and viscosity improvers. Greases may be prepared by adding thickeners, as for example salts and complexes of fatty acids, polyurea compounds, clays and quarternary ammonium bentonite. Depending on the intended use of the lubricant, other functional additives may be added to enhance a particular property of the lubricant.

The lubricating compositions may further contain other antioxidants, extreme pressure agents, metal passivators, rust inhibitors and antiwear agents.

The following examples are given for the purpose of further illustrating the invention. All percentages and parts are based on weight unless otherwise indicated.

EXAMPLE I

The rotary bomb oxygen uptake test was performed to demonstrate the synergistic performance of the compositions of the invention as compared to compositions containing only the individual components.

The test was conducted essentially according to the method described by G. H. Von Fuchs, Lubricating Eng., vol. 16, 1, 22-31, 1960. The oxidation induction time of the lubricant was measured under conditions which simulate the high temperature severe oxidation processes in engines by a rotary bomb oxidation test method ASTM D-2272. The test was conducted with 50 gram samples of SUNVIS 21 base oil manufactured by Sun Oil Company with a copper catalyst obtained from the National Bureau of Standards. The oil contained 5 ml water. Synergistic compositions of the invention and the individual components were added to the oil in the amounts indicated in Table I. The test was conducted at 150 C and initial oxygen pressure of 620.6 kPa (90 psi). A "pass" oil has a high induction time, while a "fail" oil has a low induction time. The data compiled in Table I demonstrate superior oxidation inhibition and synergistic performance by the additive compositions of the invention as compared to the individual additive components.

The above embodiments have shown various aspects of the present invention. Other variations will be evident to those skilled in the art and such modifications are intended to be within the scope of the invention as defined in the appended claims.

1. A lubricating composition comprising a major portion of a mineral oil or synthetic lubricating oil, fluid or grease and 0.01 to 5.0 percent by weight of an antioxidant composition consisting of (a) 1-[di(4-octylphenyl)aminomethyl]tolutriazole and (b) at least one antioxidant selected from the group consisting of methylenebis(di-n-butyldithiocarbamate), 2,6-di-t-butyl-4-sec-butylphenol, 2,6-di-t-butyl-4-methylphenol and butylated phenol mixture, wherein the weight ratio of component (a) to component (b) ranges from about 1:4 to 4:1.

2. A method of stabilizing against oxidation lubricating compositions by adding thereto 0.01 to 5.0 percent by weight of an antioxidant composition consisting of (a) 1-[di(4-octylphenyl)aminomethyl]tolutriazole and (b) at least one antioxidant selected from the group consisting of methylenebis(di-n-butyldithiocarbamate), 2,6-di-t-butyl-4-sec-butylphenol, 2,6-di-t-butyl-4-methylphenol and butylated phenol mixture, wherein the weight ratio of component (a) to component (b) ranges from about 1:4 to 4:1.

TABLE I

| COMPONENTS | COMPOSITIONS, PERCENT | | | | | | | | | |
|---|---|---|---|---|---|---|---|---|---|---|
| | 1 | 2 | 3 | 4 | 5 | 6 | 7 | 8 | 9 | 10 |
| Base oil | 100.00 | 99.50 | 99.50 | 99.50 | 99.50 | 99.50 | 99.50 | 99.50 | 99.50 | 99.50 |
| 1-[Di(4-octylphenyl)aminomethyl] tolutriazole | — | 0.50 | 0.40 | 0.30 | 0.25 | 0.20 | 0.10 | 0.00 | 0.25 | 0.25 |
| Methylenebis(di-n-butyldithiocarbamate) | — | — | 0.10 | 0.20 | 0.25 | 0.30 | 0.40 | 0.50 | — | — |
| 2,6-di-t-butyl-4-methylphenol | — | — | — | — | — | — | — | — | 0.25 | — |
| Butylated phenol[1] | — | — | — | — | — | — | — | — | — | 0.25 |
| Physical Properties | | | | | | | | | | |
| Average Induction Time, Min. | 55 | 190 | 865 | 1380 | 1535 | 1415 | 1605 | 55 | 589 | 539 |

[1]ETHYL Antioxidant 732

What is claimed is:

* * * * *